United States Patent [19]

Godfrey et al.

[11] 4,109,177

[45] Aug. 22, 1978

[54] CATHODE-RAY TUBE HAVING APERTURED MASK

[75] Inventors: Richard Hugh Godfrey; Albert Maxwell Morrell, both of Lancaster, Pa.

[73] Assignee: RCA Corporation, New York, N.Y.

[21] Appl. No.: 165,098

[22] Filed: Jul. 22, 1971

[51] Int. Cl.[2] ..... H01J 29/07; H01J 29/32

[52] U.S. Cl. ..... 313/402; 313/408

[58] Field of Search ..... 313/85 S, 92 B

[56] References Cited

U.S. PATENT DOCUMENTS

| | | | |
|---|---|---|---|
| 2,947,899 | 8/1960 | Kaplan | 313/92 B |
| 3,358,175 | 12/1967 | Morrell et al. | 313/92 B |
| 3,632,339 | 1/1972 | Khan | 313/92 B |
| 3,652,895 | 3/1972 | Tsuneta et al. | 313/85 S |
| 3,686,525 | 8/1972 | Naruse et al. | 313/402 |

*Primary Examiner*—Robert Segal

*Attorney, Agent, or Firm*—G. H. Bruestle; L. Greenspan

[57] ABSTRACT

A cathode-ray tube with either a positive-or a negative tolerance viewing-screen structure comprises an evacuated envelope, a luminescent viewing screen within the envelope and means for exciting the screen to luminescence. The tube includes means, such as an apertured mask or a light-absorbing matrix, for selectively defining to the viewer an array of discrete excited areas in the screen which are noncircularly graded in size, with the largest areas in the central portion of the screen and the smallest areas in the peripheral portions of the screen.

16 Claims, 6 Drawing Figures

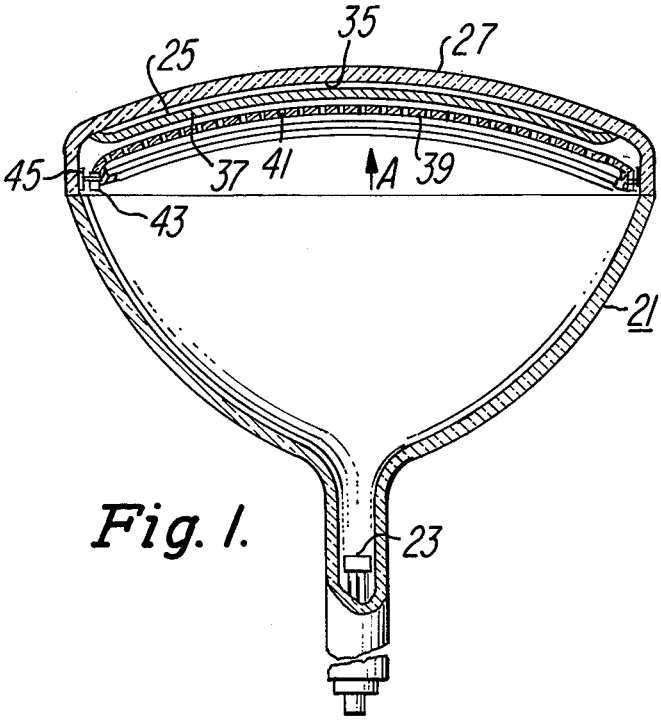
Fig. 1.
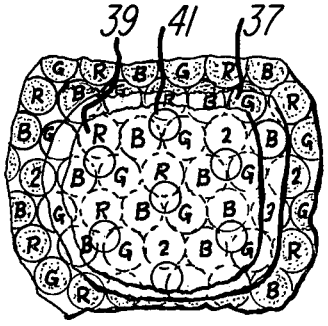
Fig. 2.
Fig. 3.
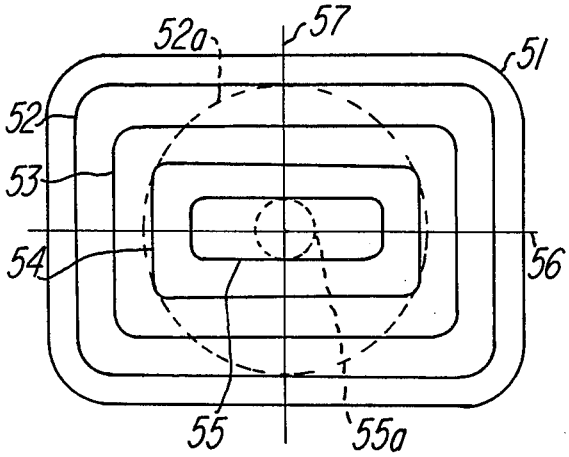
Fig. 4.
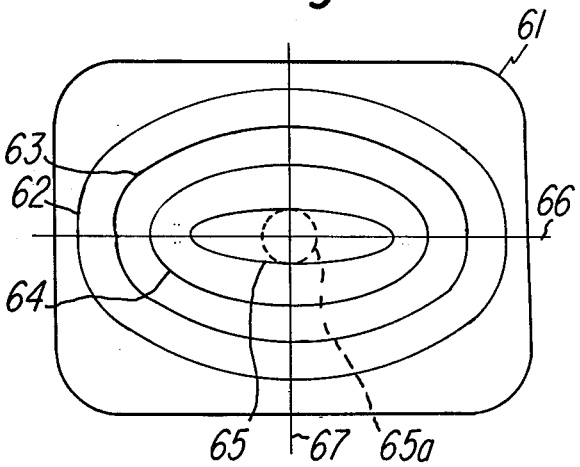

INVENTORS
Albert M. Morrell &
Richard H. Godfrey
BY L. Greenspan
ATTORNEY

CATHODE-RAY TUBE HAVING APERTURED MASK

BACKGROUND OF THE INVENTION

This invention relates to a novel cathode-ray tube having a viewing screen and means for defining to a viewer an array of discrete excited areas of the screen.

Color television picture tubes which include means for defining an array of discrete excited areas of the viewing screen have been described previously. In one form, referred to as a positive-tolerance tube, the defining means includes an apertured mask located between the cathode and the screen. The apertures of the mask shadow the screen and thereby define the excited areas of the screen. In another form, referred to as a negative-tolerance tube, the tube includes an apertured mask located between the cathode and the screen and also a light-absorbing matrix adjacent the screen and between the screen and the viewer. The matrix has an array of holes therethrough which define to the viewer excited portions of the screen.

At first, the positive-tolerance tube comprised a round envelope, a round screen and a round mask with apertures of substantially uniform size. Later, it was proposed to grade the size of the apertures, and therefore the excited areas of the screen, with the smallest apertures at the peripheral portions of the mask and the largest apertures at the central portion of the mask. This is sometimes referred to as radial or circular grading. Apertures of the same size were located in a circle at the same distance from the screen center. With increased aperture size at the central portion of the screen, the tube exhibits greater overall brightness to the viewer. With smaller aperture size at the peripheral portions of the screen, the tube exhibits greater tolerance to misregister. See, for example, U.S. Pat. Nos. 2,755,402 to A. M. Morrell and 3,109,116 to D. W. Epstein et al.

Picture tubes comprised of rectangular envelopes, rectangular screens and rectangular masks have replaced substantially all of the round tubes. However, where grading of the aperture sizes in the mask is used, circular grading is still used. This follows the general belief that optimum performance is achieved with circular or radial symmetry about the longitudinal axis of the tube. With the introduction of negative-tolerance tubes, similar circular grading was used for the light-absorbing matrix for essentially the same reasons. Nevertheless, further improvements in brightness and/or misregister tolerance are desirable for both positive- and negative-tolerance tubes.

SUMMARY OF THE INVENTION

The novel tube may be either a positive or a negative tolerance cathode-ray tube. As in the prior art, the tube includes an evacuated envelope, a luminescent viewing screen within the envelope and means for exciting the screen to luminescence. The novel tube includes means for selectively defining to the viewer an array of discrete excited areas in the screen which are noncircularly graded in size, with the largest areas at the central portion of the screen and the smallest areas in the peripheral portions of the screen. Thus, areas of equal size are not, as in the prior art, equally distant from the center of the screen.

In one form, the size grading of the areas may be rectangular, in which case equally-sized areas are located in a rectangle having rounded corners. In another form, the size grading of the areas may be elliptically distributed, in which case equal-sized areas are located on an ellipse. By employing noncircular grading of the excited areas, one may, particularly with rectangular tubes, provide additional improvements in overall screen brightness and/or misregister tolerance over similar tubes with circular grading. In a broad sense, noncircular grading permits greater design freedom to trade off screen brightness and/or misregister tolerance than similar tubes with circular grading.

BRIEF DESCRIPTION OF DRAWINGS

FIG. 1 is a longitudinal sectional view of a three-beam tricolor cathode-ray tube of the shadow mask, dot screen variety which employs the invention.

FIG. 2 is a fragmentary plan view of the mask and screen structure of the tube of FIG. 1 viewed in the direction of the arrow A.

FIG. 3 is a graphical representation of a plan view of a shadow mask having rectangular grading of the sizes of the apertures therein.

FIG. 4 is a graphical representation of a plan view of a shadow mask having elliptical grading of the sizes of the apertures therein.

DESCRIPTION OF THE PREFERRED EMBODIMENTS

Figure 5:
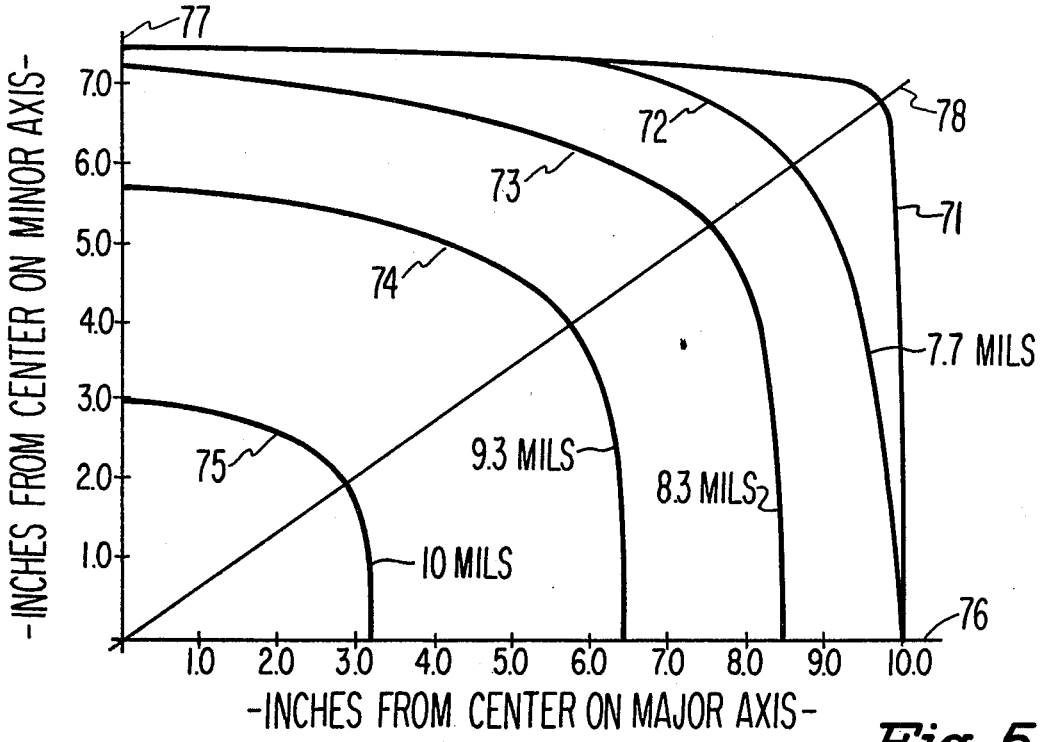
FIG. 5 is a graphical representation of a plan view of the upper righthand quadrant of a shadow mask having oval grading of the sizes of the apertures therein.

The invention may be embodied in any cathode-ray tube which employs a shadow mask and a mosaic or dot screen. Such tubes find widespread use as color television picture tubes. A typical structure for the novel tube, shown in FIGS. 1 and 2, is a rectangular color television picture tube comprised of a glass envelope 21 having an electron-gun assembly 23 at one end, so adapted to project three electron beams at a target structure at the opposite side of the envelope 21. The target structure includes a luminescent viewing screen 25 supported on a glass faceplate 27, which faceplate is part of the envelope 21. The screen is comprised of a multiplicity of red-emitting, green-emitting and blue-emitting phosphor dots, R, B, and G respectively, adhered to the inner surface 35 of the faceplate 27. The dots are arranged in a regular repetitive order of triads of three dots, one dot being of each color-emission characteristic. The dot structure is overlaid with a reflective coating 37 of aluminum. Closely spaced from the faceplate 27 toward the gun assembly 23 is a metal shadow mask 39 having a multiplicity of apertures 41 therein, one aperture for each triad. The apertures are graded in size, with the largest being in the central portion of the mask and the smallest being in the peripheral portions of the mask in a noncircular array, as will be described in more detail below. The mask is supported on studs 45 attached to the envelope 21 by four springs 43 attached to the mask 39. The apertured mask 39 is so positioned between the gun assembly 23 and the faceplate 27 that, during tube operation, an electron beamlet from each of the three beams passes through each aperture of the mask 39 at a different angle and excites a different one of the three phosphor dots of the triad. Thus, the first electron beam can excite all of the red-emitting dots, the second electron beam can excite all of the green-emitting dots, and the third electron beam can excite all of the blue-emitting dots. The blue-emitting dots preferably consist essentially of a silver-activated zinc-sulfide phosphor. The green-emitting dots preferably consist of a copper-activated zinc-cadmium-sulfide phosphor, and the red-emitting dots preferably consist essentially of an europium-activated yttrium-oxysulfide phosphor. Other phosphor compositions may be used in place of the phosphors mentioned.

EXAMPLE 1

In this example, the mask apertures 41 of the mask 39 have a rectangular grading. By "grading" is meant that the apertures increase in size from edge to center. By "rectangular" grading is meant that the projection of apertures located substantially equally distant from the edge of the viewable screen area have an equal size. As shown in FIG. 3, on the plan view of the mask for a 25-inch, 110°-deflection picture tube, apertures on the equisized contour line 52 each have a diameter of about 7.50 mils, apertures on the contour line 53 each have a diameter of about 8.00 mils, apertures on the contour line 54 each have a diameter of about 8.50 mils, and apertures on the contour line 55 each have a diameter of about 9.00 mils. The sizes of the projections from these apertures are slightly larger as is known in the art. The projection of each of the contour lines 52 through 55 is equidistant from the nearest edge of the viewable screen area of the tube. In most cases, the contour lines are also substantially equally distant from the edge of the mask. The projection of the major and minor axes 56 and 57 intersect at the center of the viewable screen area. The dotted lines 52*a* and 55*a* are the contour lines (corresponding to contour lines 52 and 55 respectively) for a similar tube having a circular mask aperture grading.

EXAMPLE 2

In this example, the mask apertures 41 have an elliptical grading. By "elliptical" grading is meant that the projection of apertures located along an ellipse are equally sized. The projection of each ellipse is equally distant from the nearest edges 61 of the viewable screen area along the vertical and horizontal axes 56 and 57 respectively through the screen center but is further removed from the nearest edges between these axes. As shown in FIG. 4 for a 25-inch, 110° picture tube, apertures along the contour lines 62, 63, 64 and 65 have equal diameters of about 7.50, 8.00, 8.50 and 9.00 mils respectively. Each contour line is an ellipse described by radii from a pair of centers along the horizontal axis 67 through the screen center. The projection of each ellipse passes an equal distance from the sides, top and bottom 61 of the viewable screen area where it intersects the vertical and horizontal axes 66 and 67. The dotted line 65*a* is the contour line (corresponding to the contour line 65) for a similar tube having circular mask grading.

EXAMPLE 3

Figure 6:
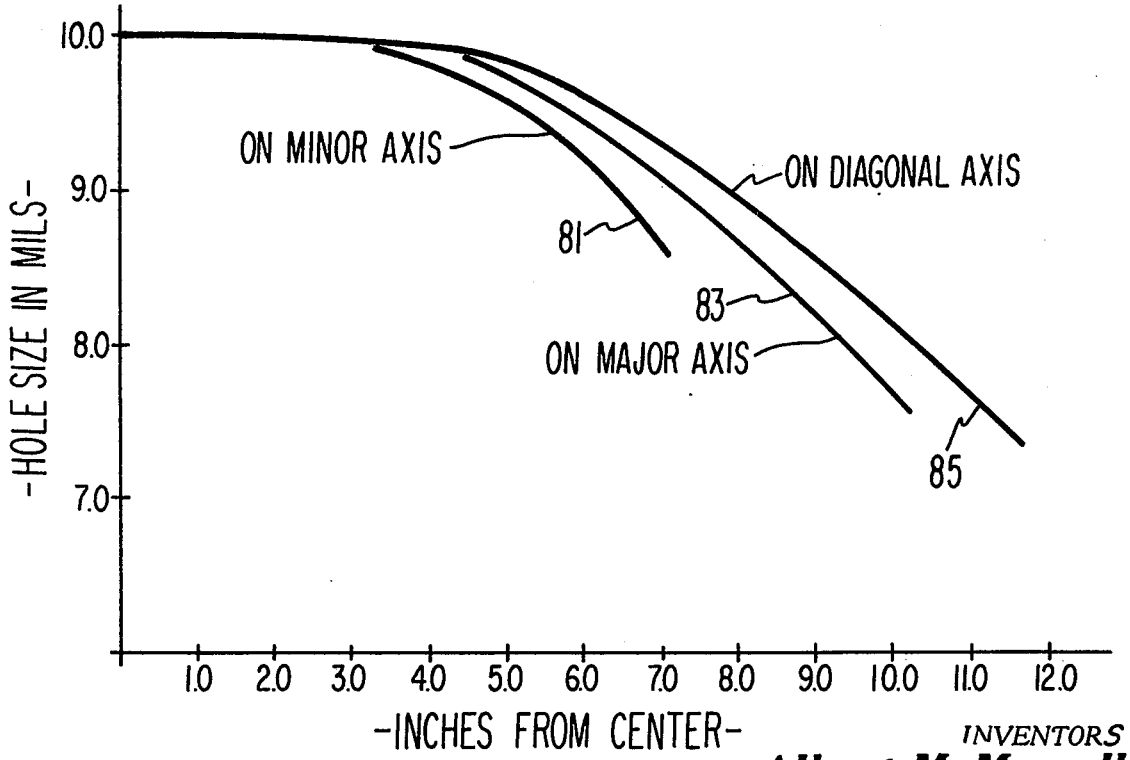
FIG. 6 is a family of graphs indicating the aperture sizes of the mask shown in FIG. 5 along the major axis, the minor axis, and the longest diagonal through the intersection of the major and minor axes.

In this example, the mask apertures have oval grading, which is at present the preferred embodiment. By "oval" grading is meant a grading between rectangular and elliptical as described in Examples 1 and 2 respectively. FIG. 5 shows the upper righthand quadrant of the viewable screen area of a mask for a 25-inch, 110°-deflection picture tube. The contour lines 72, 73, 74 and 75 locate apertures of equal size of 7.7, 8.3, 9.3 and 10.0 mils respectively. FIG. 5 also shows the longest diagonal 78 of the mask through the screen center, which is the intersection of the major axis 76 and the minor axis 77. The grading of aperture sizes along the minor, major and diagonal axes is also described by the curves 81, 83 and 85 respectively shown in FIG. 6. For circular grading, all of these curves would fall on top of one another in FIG. 6. The separation of the curves indicates the screen areas for which improvements in brightness and/or misregister tolerance can be realized.

SOME GENERAL CONSIDERATIONS AND ALTERNATIVES

The examples disclose several grading patterns which are noncircular. By employing a noncircular grading, the novel tube may be designed to provide additional overall screen brightness and/or misregister tolerance, or a combination of the two over tubes with circular grading. Which particular grading pattern is optimum for any particular tube design is determined by the needs for misregister tolerance, brightness, aesthetic effects to the viewer, etc. While the contour lines are generally symmetrical about the major and minor axes of the screen or mask, there may be minor asymmetries in the actual contour lines which accommodate to detailed needs for misregister tolerance in the viewing screen. Furthermore, combinations of different grading patterns may be used in the same mask or matrix.

Magnetic deflection influences the requirements for aperture-size grading. To provide off-axis convergence of the electron beams in a color picture tube, the beam-convergence characteristics of the deflection yokes are tailored to produce horizontal and vertical scan-rate dynamic-convergence requirements which are additive. This generally results in astigmatism progressively added to the beam-triad pattern along the major and minor axes. This astigmatism is usually negative, that is, it produces a beam-triad-distortion pattern which adds further to that already present due to the obliquity of the screen plane relative to the deflection plane. This distortion is intrinsically a screen-tolerance limiter which, once optimum beam spot to dot register is achieved, can then be further accommodated by reducing the aperture-defined beam-spot size. Thus, beam-spot-size requirements call for an aperture-size grading which is a function of a symmetrical portion of the screen and of the distance from the screen center. Practically speaking, the maximum grading requirements for tolerance are greater nearer the minor and major axes of the screen than they are at the larger radii of the diagonals. Some yoke designs require maximum enhancement of screen tolerance at or near the minor axis of the tubes; and others require maximum enhancement at or near the major axis. The noncircular grading of aperture size, according to the invention may be used to provide the required tolerance at or near the axes of the screen and to take advantage of the lower tolerance required for areas along the diagonals between the axes by providing greater brightness in these areas.

The invention has been described as applied to a tube having a positive-tolerance, nonmatrix screen structure in which the mask apertures define the electron-spot size, and the electron-spot sizes are smaller than the phosphor dots they excite. In this type tube, the viewer sees the entire excited area of the dot. A novel tube with a positive-tolerance screen structure may employ a light-absorbing matrix, for example, as described in U.S. patent application Ser. No. 827,573, filed May 26, 1969, for D. D. VanOrmer. In such positive-tolerance, matrix tubes, the aperture mask is constructed in the same manner as described in the examples. The invention may also be applied to a tube having a negative-tolerance, matrix screen structure, for example, as described in U.S. Pat. Nos. 2,842,697 to F. J. Bingley and 3,146,368 to J. P. Fiore et al. In such a negative-tolerance matrix tube, the mask apertures define the electron-spot size, but the matrix holes are smaller than the electron-spot sizes so that the viewer sees only that portion of the excited phosphor dots which is not masked by the matrix. For such negative-tolerance-screen structures, the matrix-hole size is noncircularly (e.g., rectangularly, elliptically, or ovally) graded according to the invention rather than the mask apertures.

A common quality of positive-tolerance and negative-tolerance-screen tubes is that each screen structure includes means for selectively defining to the viewer an array of discrete excited areas in the screen. In the case of a positive-tolerance screen structure, it is the sizes of the mask apertures that define the excited areas to the viewer. In the case of a negative-tolerance screen structure it is the sizes of the matrix holes that define the excited areas to the viewer. In both cases, according to the invention, the discrete excited areas defined to the viewer are noncircularly graded in size with the largest areas being in the central portion of the screen and the smallest areas being in the peripheral portions of the screen.

To maximize the absolute tolerance in certain negative tolerance matrix tubes and to achieve a desirable balance between clipping and leaving tolerances in them, it is advantageous to noncircularly grade both matrix-hole and mask-aperture diameters. Such grading patterns would not necessarily track one with the other since the roles of each differ in their relationship to tolerance and brightness. The matrix would dictate the overall tolerance level (and screen brightness) and play the dominant role in subjective screen appearance, both scanned and nonscanned. The aperture mask would control the balance between the leaving tolerances and the clipping tolerances throughout the screen.

Masks having noncircularly graded aperture sizes may be made by the usual photoresist-and-etching techniques used to make other types of apertured masks; for example, as described in the above-cited patent to A. M. Morrell. However, the prior methods are modified by exposing the photoresist to light through a photographic master having opaque dot areas which are noncircularly graded in size at locations where the apertures are desired. Light-absorbing matrices having noncircularly graded hole sizes may be made by the photographic methods described in U.S. Pat. No. 3,558,310 to E. E. Mayaud by using masks having noncircularly graded aperture sizes and/or by light fields which are graded in brightness from center (most bright) to edge (least bright).

The invention may be applied to cathode-ray tubes which are circular, rectangular or any other shape. For any of these tube shapes, the grading of the excited screen areas defined to the viewer is noncircular as described above. It is not dependent upon the shape of the tube but is described with respect to the viewable screen area of the tube. The viewable area of the screen for each of these tubes is that area which, by the design of the tube, is available to convey information to the viewer.

We claim:

1. In a cathode-ray tube comprising:

(1) an evacuated envelope, (2) a luminescent viewing screen within said envelope, said viewing screen comprising a plurality of different color light-emitting areas arranged in repetitive order, (3) means for projecting a plurality of electron beams toward said screen for exciting said screen to luminescence, said plurality of beams being equal in number to said plurality of different colors, (4) and means including an apertured mask closely spaced from said viewing screen for selectively defining to the viewer during the operation of said tube an array of discrete excited luminescent areas in said screen, which areas are graded in size with the largest areas being in the central portion of the screen and the smallest areas being in the peripheral portions of the screen, the improvement wherein defined areas of equal size are located on one of a family of closed noncircular curves, each curve having a major horizontal axis and a minor vertical axis intersecting at about the center of said screen and being generally symmetrical about said axes.

2. The tube defined in claim 1 wherein said tube is a positive-tolerance tube and said defining means comprises the apertures of an apertured mask located between said viewing screen and said means for exciting said screen.

3. The tube defined in claim 2 wherein said mask apertures are rectangularly graded in size.

4. The tube defined in claim 2 wherein said mask apertures are elliptically graded in size.

5. The tube defined in claim 2 wherein said mask apertures are ovally graded in size.

6. The tube defined in claim 1 wherein said tube is a negative-tolerance tube and said defining means comprises the holes in a light-absorbing matrix located adjacent said screen in said tube.

7. The tube defined in claim 6 wherein said matrix holes are rectangularly graded in size.

8. The tube defined in claim 6 wherein said matrix holes are elliptically graded in size.

9. The tube defined in claim 6 wherein said matrix holes are ovally graded in size.

10. A black surround color television picture tube having a substantially rectangular faceplate and a screen assembly including an aperture mask spaced from a plurality of viewable image elements distributed in a regular repetitive order in a rectangular field over the faceplate and characterized in that said viewable image elements diminish gradually in area from the center to the edge of the faceplate such that elements having the same area are disposed on concentric loci which are centered in said field and which have a substantially rectangular geometry, said loci having major horizontal axes and minor vertical axes.

11. A black surround color television picture tube as set forth in claim 10 wherein said viewable image elements comprise, light emitting color phosphors arranged in groups of red, blue and green.

12. A black surround color television picture tube as set forth in claim 11 wherein said viewable image elements comprise dots of said light emitting phosphors arranged in triads, said dots being spaced apart from each other on said faceplate and having areas diminishing in accordance with said pattern.

13. A rectangular screen assembly for a color television picture tube including a matrix of light absorbing material on said faceplate, said matrix having holes arranged in a regular repetitive order in a rectangular field over said faceplate coextensive with the maximum viewable areas of light emitting phosphors, said holes having areas diminishing in accordance with distance from the center of said faceplate and arranged in a pattern characterized in that lines of holes of substantially the same areas occur at the same percentage of distance from said center, said lines of holes having major horizontal axes and minor vertical axes.

14. A screen assembly for a color cathode ray tube having a faceplate with a black surround grille including a multiplicity of holes, each defining the viewable area of an associated deposit of light emitting phosphor, distributed in a regular repetitive order throughout said faceplate with an area grade characterized in that the hole areas decrease in a predetermined manner with distance from the center of the faceplate and further characterized in that holes having substantially the same areas are disposed along a substantially rectangular locus centered in said faceplate so that the screen assembly, when incorporated into a tube, will have a viewable phosphor area characteristic comprising a concentric series of substantially rectangularly shaped patterns of equal brightness, said patterns having major horizontal axes and minor vertical axes.

15. A screen assembly as set forth in claim 14 wherein said holes are circular and said phosphors comprise deposits of red, green and blue light emitting phosphor materials.

16. A black surround color television picture tube having a substantially rectangular faceplate and a screen assembly including an aperture mask spaced from a plurality of viewable image elements distributed in a regular repetitive order in a rectangular field over the faceplate and characterized in that in at least one common coordinate direction said viewable image elements diminish gradually in dimension from the center to the edge of the faceplate such that elements having the same value of said dimension in said common coordinate direction are disposed on concentric loci which are centered in said field and which have a non-circular geometry, said loci having major horizontal axes and minor vertical axes.

* * * * *

UNITED STATES PATENT AND TRADEMARK OFFICE
CERTIFICATE OF CORRECTION

PATENT NO. : 4,109,177

DATED : August 22, 1978

INVENTOR(S) : Richard Hugh Godfrey and Albert Maxwell Morrell

It is certified that error appears in the above-identified patent and that said Letters Patent is hereby corrected as shown below:

| | |
|---|---|
| Abstract, line 2 | before "tolerance" insert -- - -- |
| Column 6, line 6 | before "repetitive" insert --a regular-- |

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*